US010689802B2

(12) United States Patent
Meguro

(10) Patent No.: US 10,689,802 B2
(45) Date of Patent: Jun. 23, 2020

(54) NAPPED ARTIFICIAL LEATHER AND PRODUCTION METHOD THEREOF

(71) Applicant: KURARAY CO., LTD., Kurashiki-shi (JP)

(72) Inventor: Masashi Meguro, Okayama (JP)

(73) Assignee: KURARAY CO., LTD., Kurashiki-shi (JP)

( * ) Notice: Subject to any disclaimer, the term of this patent is extended or adjusted under 35 U.S.C. 154(b) by 0 days.

(21) Appl. No.: 16/306,697

(22) PCT Filed: Jun. 21, 2017

(86) PCT No.: PCT/JP2017/022802
§ 371 (c)(1),
(2) Date: Dec. 3, 2018

(87) PCT Pub. No.: WO2017/221961
PCT Pub. Date: Dec. 28, 2017

(65) Prior Publication Data

US 2019/0127908 A1 May 2, 2019

(30) Foreign Application Priority Data

Jun. 22, 2016 (JP) ..... 2016-123411

(51) Int. Cl.
*D06N 3/00* (2006.01)
*D06N 3/18* (2006.01)

(52) U.S. Cl.
CPC ..... *D06N 3/0075* (2013.01); *D06N 3/00* (2013.01); *D06N 3/0004* (2013.01); *D06N 3/0011* (2013.01); *D06N 3/183* (2013.01); *D06N 2211/28* (2013.01); *D06N 2213/03* (2013.01)

(58) Field of Classification Search
CPC ..... D06N 3/00; D06N 3/0004; D06N 3/0075; D06N 3/0011; D06N 3/183; D06N 2211/28; D06N 2213/03
See application file for complete search history.

(56) References Cited

U.S. PATENT DOCUMENTS

| | | | | |
|---|---|---|---|---|
| 2015/0050460 | A1* | 2/2015 | Fujisawa | D06C 21/00 428/151 |
| 2016/0215444 | A1 | 7/2016 | Ashida et al. | |
| 2017/0183815 | A1 | 6/2017 | Kuroda et al. | |

FOREIGN PATENT DOCUMENTS

| | | | |
|---|---|---|---|
| CN | 105178052 | A | 12/2015 |
| EP | 2 821 545 | A1 | 1/2015 |
| JP | 2003-94320 | A | 4/2003 |
| JP | 2011-74541 | A | 4/2011 |
| JP | 2012-184537 | A | 9/2012 |
| JP | 2014-163005 | A | 9/2014 |
| JP | WO 2015/045367 | A1 | 4/2015 |
| JP | WO 2015/151872 | A1 | 10/2015 |
| JP | 2017-106127 | A | 6/2017 |
| KR | 10-2010-0103893 | A | 9/2010 |

OTHER PUBLICATIONS

International Search Report dated Aug. 29, 2017 in PCT/JP2017/022802 filed Jun. 21, 2017.
Extended European Search Report dated Dec. 4, 2019 in European Patent Application No. 17815429.0.

* cited by examiner

*Primary Examiner* — Amina S Khan
(74) *Attorney, Agent, or Firm* — Oblon, McClelland, Maier & Neustadt, L.L.P.

(57) ABSTRACT

Disclosed is a napped artificial leather including: a fabric that has been impregnated with a first elastic polymer and that has a napped surface including napped ultrafine fibers with an average fineness of 0.01 to 0.5 dtex, wherein the napped surface has, as measured by a surface roughness measurement in accordance with ISO 25178, an arithmetic mean height (Sa) of 30 μm or less in both a grain direction and a reverse grain direction, and a density of peaks (Spd) having a height of 100 μm or more from a mean height, of 30/432 $mm^2$ or less in both of the grain direction and the reverse grain direction, and a difference (absolute value) in the density of peaks (Spd) between the grain direction and the reverse grain direction is 20/432 $mm^2$ or less.

8 Claims, 4 Drawing Sheets

NAPPED ARTIFICIAL LEATHER AND PRODUCTION METHOD THEREOF

TECHNICAL FIELD

The present invention relates to a napped artificial leather for use as surface materials for clothing, shoes, articles of furniture, car seats, general merchandise, and the like. More particularly, the invention relates to a napped artificial leather that can maintain an elegant appearance when the surface there of is rubbed.

BACKGROUND ART

Conventionally, napped artificial leathers such as a suede-like artificial leather and a nubuck-like artificial leather are known. A napped artificial leather has a napped surface formed by napping the surface of a fabric such as a non-woven fabric of ultrafine fibers that has been impregnated with an elastic polymer. The napped artificial leather may have a nonuniform and coarse appearance with a rough dry touch as a result of the napped surface thereof being rubbed.

As the techniques for improving the appearance of the nubuck-like artificial leather, the following techniques are known. As an artificial leather having a wet tactile impression resembling a natural nubuck leather and an elegant appearance with a uniform color tone, PTL 1 listed below discloses an artificial leather including a fiber-entangled body including ultrafine fibers with a single fiber fineness of 0.01 dtex or more and 0.50 dtex or less, and an elastic polymer, and having at least one napped surface. The arithmetic mean height Pa of a primary profile of the napped surface is 26 μm or more and 100 μm or less, and the arithmetic mean height Pa of a primary profile of the other surface is 20% or more and 80% or less of the surface roughness Pa of the napped surface. The existence frequency of asperity peaks of the primary profile of the napped surface is 1.8 or more and 20 or less per 1.0 mm, and a woven or knitted fabric is stacked on the other surface at a depth of 10% or more and 50% or less.

CITATION LIST

Patent Literature

[PTL 1] WO 2015/151872 pamphlet

SUMMARY OF INVENTION

Technical Problem

It is an object of the present invention to provide a napped artificial leather that is less likely to have a nonuniform and coarse appearance with a rough dry touch as a result of the napped surface thereof being rubbed.

Solution to Problem

As described above, conventionally, the napped artificial leather may have a nonuniform and coarse appearance with a rough dry touch as a result of the napped surface thereof being rubbed. Such an appearance tends to be prominent as the strength per one ultrafine fiber is increased. In order to inhibit such a phenomenon, the present inventors have investigated the causes thereof, and have gain the following knowledge. When the strength per one ultrafine fiber is increased, ultrafine fibers become difficult to be cut in a napping treatment, and the ultrafine fibers forming the napped fibers existing on the napped surface become longer. Consequently, when the napped surface is rubbed, the ultrafine fibers that can easily move freely gather and become entangled. In the case where the ultrafine fibers are relatively thick, the rigidity of each of the ultrafine fibers is increased, so that the ultrafine fibers that have been concealing a base layer are excessively raised from the laid-down state. As a result, the base layer, which is a coarse portion with little napped ultrafine fibers, is exposed in some locations, so that a dry-touch surface with a nonuniform fiber density is formed, resulting in a coarse appearance. Based on the knowledge, the inventors have found that the occurrence of the above-described phenomenon can be significantly inhibited by fixing the ultrafine fibers of the napped surface in a laid-down state, and adjusting the surface state such that the ultrafine fibers cannot be easily raised above a certain height from the laid-down state when the fibers are rubbed in either a grain direction or a reverse grain direction, and thus the inventors have arrived at the present invention.

That is, an aspect of the present invention is directed to a napped artificial leather including: a fabric, such as a non-woven fabric, a woven fabric, or a knitted fabric, that has been impregnated with a first elastic polymer and that has a napped surface including napped ultrafine fibers with an average fineness of 0.01 to 0.5 dtex, wherein the napped surface has, as measured by a surface roughness measurement in accordance with ISO 25178, an arithmetic mean height (Sa) of 30 μm or less in both a grain direction and a reverse grain direction, and a density of peaks (Spd) having a height of 100 μm or more from a mean height, of 30/432 $mm^2$ or less in both of the grain direction and the reverse grain direction, and a difference (absolute value) in the density of peaks (Spd) between the grain direction and the reverse grain direction is 20/432 $mm^2$ or less. By forming such a surface state on the napped surface on which ultrafine fibers are napped, the ultrafine fibers that can be freely moved by friction become short and are brought into an appropriately laid-down state. This can provide a napped artificial leather that is less likely to have a nonuniform and coarse appearance with a rough dry touch even when the napped surface thereof is rubbed.

It is preferable that the ultrafine fibers that form the napped fibers on the napped surface have a second elastic polymer attached thereto. More particularly, it is preferable that the ultrafine fibers, or the ultrafine fibers and the first elastic polymer, are fixed to each other by the second elastic polymer. Specifically, for example, the ultrafine fibers in the vicinity of the base, or the ultrafine fibers and the first elastic polymer in the vicinity of the base, are fixed to each other by the second elastic polymer. This is preferable in that the freely movable ultrafine fibers become short in the grain direction and the reverse grain direction, and are fixed so as to be difficult to be raised from the laid-down state.

In the napped artificial leather, the fiber toughness, which is an index indicating the tenacity and the level of rigidity per one ultrafine fiber is preferably 8 to 40 cN·% on the average. This is preferable in that the fiber will not become too hard, and the fibers can be easily moved by friction, so that the fibers on the surface are appropriately laid down, thus improving the appearance.

It is preferable that, when the fabric included in the napped artificial leather is a non-woven fabric of ultrafine fibers that has been impregnated with the first elastic polymer, the ultrafine fibers are long fibers. This is preferable in that the ultrafine fibers become difficult to be pulled out by friction, so that the ultrafine fibers can be easily fixed so as to be difficult to be raised from the laid-down state.

Preferably, the napped artificial leather has an apparent density of 0.4 to 0.7 g/cm$^3$. An apparent density within such a range is preferable in that a napped artificial leather that is well-balanced in fullness and a flexible texture that can prevent poor bending involving buckling, which is also called sharp bending.

Another aspect of the present invention is directed to a production method of any one of the above-described napped artificial leathers. Specifically, the production method of a napped artificial leather includes the steps of: preparing an artificial leather base material including a fabric, such as a non-woven fabric, a woven fabric, or a knitted fabric, that has been impregnated with a first elastic polymer and that includes a surface to be napped including ultrafine fibers with an average fineness of 0.01 to 0.5 dtex; napping the surface to be napped of the artificial leather base material, to form a napped surface; attaching a second elastic polymer to the ultrafine fibers on the napped surface; and thermally setting the artificial leather base material in a state in which the artificial leather base material is shrunk along a longitudinal direction that is an orientation direction of the fibers.

Advantageous Effects of Invention

According to the present invention, it is possible to provide a napped artificial leather that is less likely to have a nonuniform and coarse appearance with a rough dry touch even when the napped surface thereof is rubbed.

DESCRIPTION OF EMBODIMENT

Figure 1:
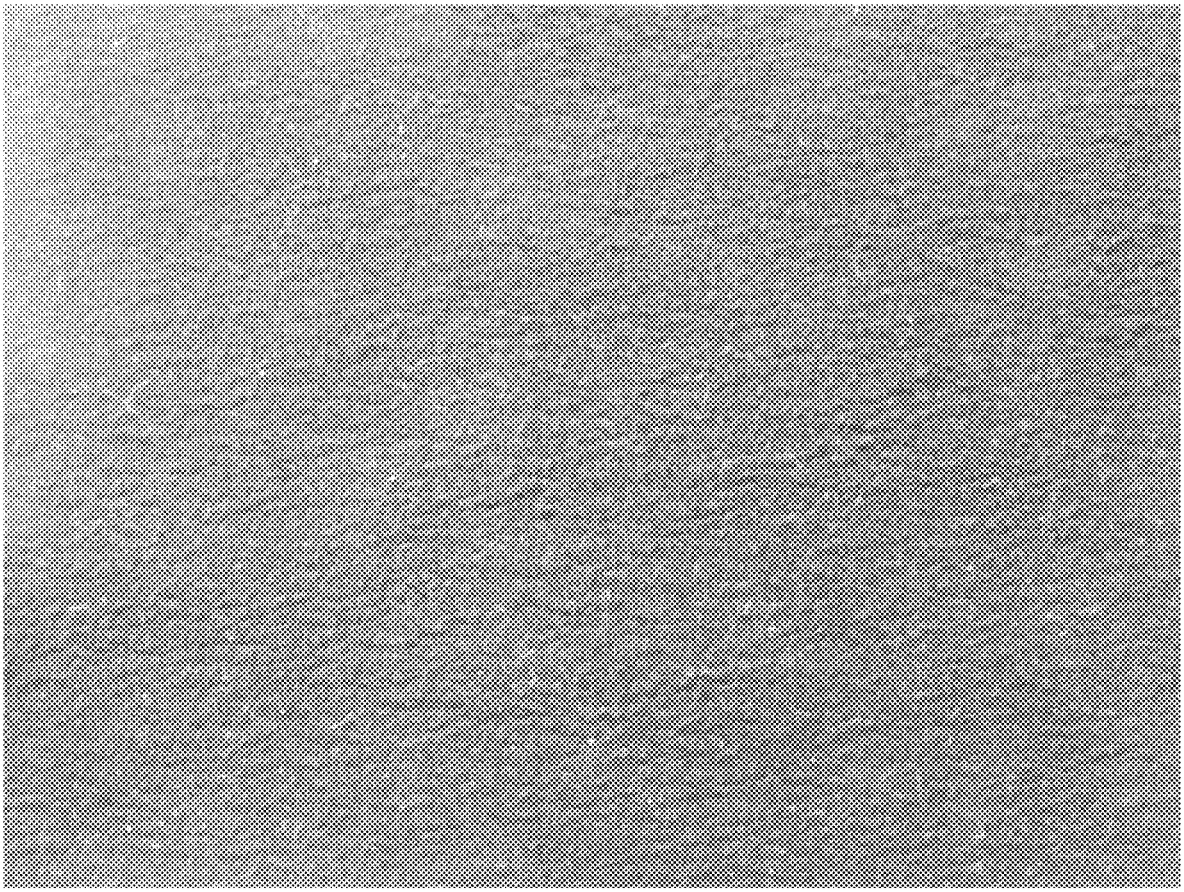
FIG. 1 is a photograph of the napped surface of a napped artificial leather obtained in Example 1 after evaluating the quality after being rubbed.

A napped artificial leather according to the present embodiment will be described in detail, in conjunction with an exemplary production method thereof.

In the production of the napped artificial leather of the present embodiment, first, there is prepared a fabric that has been impregnated with a first elastic polymer, and that includes a surface to be napped, the surface including ultrafine fibers with an average fineness of 0.01 to 0.5 dtex. Examples of the fabric include fabrics into which the first elastic polymer has been impregnated, such as a non-woven fabric of ultrafine fibers, as well as a woven fabric of ultrafine fibers, a knitted fabric of ultrafine fibers, and a fiber structure formed by combination thereof. In the present embodiment, a case where a non-woven fabric of ultrafine fibers that has been impregnated with the first elastic polymer is used as the fabric will be described in detail as a representative example.

In the production of the non-woven fabric of ultrafine fibers, first, a fiber web of ultrafine fiber-generating fibers is produced. Examples of the production method of the fiber web include a method involving melt-spinning ultrafine fiber-generating fibers and directly collecting the resultant fibers as long fibers without intentionally cutting them, and a method involving cutting the resultant fibers into staples and subjecting them to a known entangling treatment. Note that the long fibers may also be referred to as "filaments", and are continuous fibers other than staples that have been cut into a predetermined length. From the viewpoint of sufficiently increasing the fiber density, the length of the long fibers is preferably 100 mm or more, more preferably 200 mm or more. The upper limit for the length of the long fibers is not particularly limited, and may be several meters, several hundred meters, several kilometers, or longer, and continuously spun. Among these, it is preferable to produce a long-fiber web (spunbonded sheet) of ultrafine fiber-generating fibers in that the ultrafine fibers become difficult to be pulled out by friction, so that a napped artificial leather in which the ultrafine fibers are fixed so as to be difficult to be raised from the laid-down state can be obtained. In the present embodiment, the production of a long-fiber web of ultrafine fiber-generating fibers will be described in detail as a representative example.

Here, "ultrafine fiber-generating fibers" refer to fibers for forming ultrafine fibers by subjecting spun fibers to a chemical or physical post-treatment. Specific examples thereof include an island-in-the-sea composite fiber in which a polymer of an island component serving as a domain different from a sea component is dispersed in a polymer of the sea component serving as a matrix on the fiber cross section, and the sea component is later removed to form a fiber bundle-like ultrafine fiber composed mainly of the island component polymer; and a strip/division-type composite fiber in which a plurality of different resin components are alternately disposed around the periphery of a fiber to form a petaline shape or a superposed shape, and the fiber is divided as a result of the resin components being stripped from the fiber by a physical treatment, thereby forming a bundle-like ultrafine fiber. The use of the island-in-the-sea composite fiber can prevent damage to the fibers such as cracking, bending, and breaking during an entangling treatment such as needle punching, which will be described below. In the present embodiment, the formation of ultrafine fibers of long fibers (ultrafine long fibers) by using the island-in-the-sea composite fibers will be described in detail as a representative example.

The island-in-the-sea composite fiber is a multicomponent composite fiber composed of at least two polymers, and has a cross section on which an island component polymer is dispersed in a matrix composed of a sea component polymer. A long-fiber web of the island-in-the-sea composite fibers is formed by melt-spinning the island-in-the-sea composite fibers and directly collecting the resultant fibers as long fibers on a net without cutting them.

The island component polymer is not particularly limited so long as it is a polymer capable of forming an ultrafine fiber. Specific examples thereof include polyester-based resins such as polyethylene terephthalate (PET), polytrimethylene terephthalate (PTT), polybutylene terephthalate (PBT) and a polyester elastic body or modified products thereof with isophthalic acid or the like; polyamide-based resins such as polyamide 6, polyamide 66, polyamide 610, polyamide 12, an aromatic polyamide, a semi-aromatic polyamide, a polyamide elastic body or modified products thereof; polyolefin-based resins such as polypropylene; and polyurethane-based resins such as a polyester-based polyurethane. Among these, polyester-based resins such as PET, PTT, PBT and modified polyesters thereof are preferable in that they are easily shrinkable by a heat treatment and thus can provide a napped artificial leather having fullness. Also, polyamide-based resins such as polyamide 6 and polyamide 66 are preferable in that they can provide ultrafine fibers having hygroscopicity and pliability as compared with those obtained by polyester-based resins, and thus can provide a napped artificial leather having fluffiness and a soft texture. The island component polymer may further contain a colorant such as a pigment, an antioxidant, an ultraviolet absorber, a fluorescent agent, an antifungal agent, an inorganic fine particles, and the like, so long as the effects of the present invention are not impaired.

As the sea component polymer, a polymer having higher solubility in a solvent or higher decomposability by a decomposition agent than those of the island component polymer is selected. Also, a polymer having low affinity for the island component polymer and a smaller melt viscosity and/or surface tension than the island component polymer under the spinning condition is preferable in terms of the excellent stability in spinning of the island-in-the-sea composite fibers. Specific examples of such a sea component polymer include a water-soluble polyvinyl alcohol-based resin (water-soluble PVA), polyethylene, polypropylene, polystyrene, an ethylene-propylene-based copolymer, an ethylene-vinyl acetate-based copolymer, a styrene-ethylene-based copolymer, and a styrene-acryl-based copolymer. Among these, the water-soluble PVA is preferable in that it can be removed by dissolution using an aqueous solvent without using an organic solvent and thus has a low environmental load.

The island-in-the-sea composite fibers can be produced by melt spinning in which the sea component polymer and the island component polymer are melt-extruded from a multicomponent fiber spinning spinneret. The temperature of the multicomponent fiber spinning spinneret is not particularly limited so long as it is a temperature at which melt spinning can be performed and is higher than the melting point of each of the polymers constituting the island-in-the-sea composite fibers, and is usually selected from the range of 180 to 350° C.

The average fineness of the island-in-the-sea composite fibers is not particularly limited so long as ultrafine fibers of 0.01 to 0.5 dtex can be generated, and the average fineness is preferably 0.5 to 10 dtex, more preferably 0.7 to 5 dtex. An average area ratio between the sea component polymer and the island component polymer on the cross section of the island-in-the-sea composite fiber is preferably 5/95 to 70/30, more preferably 10/90 to 50/50. The number of domains of the island component on the cross section of the island-in-the-sea composite fiber is not particularly limited, but is preferably about 5 to 1000, more preferably about 10 to 300, from the viewpoint of the industrial productivity.

The molten island-in-the-sea composite fibers discharged from the multicomponent fiber spinning spinneret are cooled by a cooling apparatus, and are further drawn out and attenuated with a high-velocity air stream at a velocity corresponding to a take-up speed of 1000 to 6000 m/min by a suction apparatus such as an air jet nozzle so as to have a desired fineness. Then, the drawn and attenuated long fibers are piled on a collection surface of a movable net or the like, thereby obtaining a long-fiber web. Note that, in order to stabilize the shape, a portion of the long-fiber web may be further pressure-bonded by hot pressing the long-fiber web if necessary. The basis weight of the long-fiber web thus obtained is not particularly limited, but is preferably in the range of 10 to 1000 g/m$^2$, for example.

Then, the obtained long-fiber web is subjected to an entangling treatment, thereby producing an entangled web.

Specific examples of the entangling treatment for the long-fiber web include a treatment in which a plurality of layers of long-fiber webs are superposed in the thickness direction by using a cross lapper or the like, and subsequently needle-punched simultaneously or alternately from both sides such that at least one barb penetrates the web. The needle density (punch/cm$^2$) by needle punching per cm$^2$ is preferably 2000 to 5000 punch/cm$^2$, more preferably 2500 to 4500 punch/cm$^2$. When the needle density per cm$^2$ is too small, the level of entanglement of the non-woven fabric is reduced, so that the ultrafine fibers tend to fall out by friction on the napped surface. On the other hand, when the needle density per cm$^2$ is too large, the ultrafine fibers tend to be cut, thus reducing the entangling properties.

An oil solution, an antistatic agent, and the like may be added to the long-fiber web in any stage from the spinning step to the entangling treatment of the island-in-the-sea composite fibers. Furthermore, if necessary, the entangled state of the long-fiber web may be densified in advance by performing a shrinking treatment in which the long-fiber web is immersed in hot water at about 70 to 150° C. The fiber density may be increased by performing hot pressing after needle punching so as to provide shape stability.

If necessary, the entangled web may be subjected to a treatment in which the entangled web is heat-shrunk such that the fiber density and the degree of entanglement thereof are increased. Specific examples of the heat-shrinking treatment include a method involving bringing the entangled web into contact with water vapor, and a method involving applying water to the entangled web, and subsequently heating the water applied to the entangled web by using hot air or electromagnetic waves such as infrared rays. For the purpose of, for example, further densifying the entangled web that has been densified by the heat-shrinking treatment, fixing the shape of the entangled web, and smoothing the surface thereof, the fiber density may be further increased by performing hot pressing as needed. The change in the basis weight of the entangled web during the shrinking treatment step is preferably 1.1 times (mass ratio) or more, more preferably 1.3 times or more and 2 times or less, further preferably 1.6 times or less, as compared with the basis weight before the shrinking treatment. The basis weight of the entangled web thus obtained is preferably in the range of about 100 to 2000 g/m$^2$.

Then, the sea component polymer is removed from the island-in-the-sea composite fibers in the entangled web that has been densified, thereby obtaining an ultrafine-long-fiber non-woven fabric, which is an entangled body of fiber bundle-like ultrafine long fibers. As the method for removing the sea component polymer from the island-in-the-sea composite fibers, a conventionally known ultrafine fiber formation method such as a method involving treating the entangled web with a solvent or decomposition agent capable of selectively removing only the sea component polymer can be used without any particular limitation. Specifically, in the case of using, for example, a water-soluble PVA as the sea component polymer, it is possible to use hot water as the solvent. In the case of using a modified polyester that can be easily decomposed by alkali as the sea component polymer, it is possible to use an alkaline decomposition agent such as an aqueous sodium hydroxide solution.

In the case of using the water-soluble PVA as the sea component polymer, it is preferable to remove the water-soluble PVA by extraction until the removal rate of the water-soluble PVA becomes about 95 to 100 mass % by treating the web in hot water at 80 to 100° C. for 100 to 600 seconds. Note that the water-soluble PVA can be efficiently removed by extraction by repeating a dip-nipping treatment. The use of the water-soluble PVA is preferable in terms of a low environmental load and reduced generation of VOCs since the sea component polymer can be selectively removed without using an organic solvent.

The average fineness of the ultrafine fibers is preferably 0.01 to 0.5 dtex, more preferably 0.05 to 0.4 dtex, particularly preferably 0.1 to 0.35 dtex. When the average fineness of the ultrafine fibers exceeds 0.5 dtex, the rigidity of the ultrafine fibers becomes too high, so that the ultrafine fibers on the napped surface become easily raised by friction, making it difficult to obtain a surface state as described below. When the average fineness of the ultrafine fibers is less than 0.01 dtex, the color development and the light resistance are reduced. Note that the average fineness is determined by imaging a cross section of the napped artificial leather that is parallel to the thickness direction thereof using a scanning electron microscope (SEM) at a magnification of 3000×, and calculating an average value of the diameters of evenly selected 15 fibers by using the densities of the resins that form the fibers.

The basis weight of the non-woven fabric of ultrafine fibers is preferably 140 to 3000 g/m$^2$, more preferably 200 to 2000 g/m$^2$.

In the production of a napped artificial leather according to the present embodiment, a first elastic polymer is impregnated into the internal voids of the non-woven fabric of ultrafine fibers before or after generating ultrafine fibers from ultrafine fiber-generating fibers such as island-in-the-sea composite fibers in order to impart shape stability and fullness to the resulting non-woven fabric of ultrafine fibers.

Specific examples of the first elastic polymer include elastic bodies such as polyurethane, an acryl-based resin, an acrylonitrile-based resin, an olefin-based resin, and a polyester-based resin. Among these, polyurethane is preferable.

For the polyurethane, it is particularly preferable to use a polyurethane emulsion, or a polyurethane that is solidified from a polyurethane dispersion dispersed in an aqueous solvent. When the emulsion has thermal gelation properties, particles of the emulsion are thermally gelled without migration, thus making it possible to evenly apply the elastic polymer to the non-woven fabric.

As the method for impregnating the first elastic polymer into the non-woven fabric, it is preferable to use a method in which an emulsion, dispersion or solution containing the first elastic polymer is impregnated into an entangled web before generating ultrafine fibers, and thereafter dried and solidified by a dry method, or solidified by a wet method, since the ultrafine fibers will not become too hard as a result of voids being formed between the first elastic polymer and the surfaces of the ultrafine fibers. Here, in the case of using an elastic polymer that forms a cross-linked structure after being solidified, a curing treatment in which the polymer is heat-treated after being solidified and dried may be performed in order to promote crosslinking, if necessary.

Examples of the method for impregnating the emulsion, dispersion or solution of the first elastic polymer include dip-nipping in which a treatment of nipping by a press roll or the like to achieve a predetermined impregnated state is performed once or a plurality of times, bar coating, knife coating, roll coating, comma coating, and spray coating.

Note that the first elastic polymer may further contain a colorant such as a dye or a pigment, a coagulation regulator, an antioxidant, an ultraviolet absorber, a fluorescent agent, an antifungal agent, a penetrant, an antifoaming agent, a lubricant, a water-repellent agent, an oil-repellent agent, a thickener, a filler, a curing accelerator, a foaming agent, a water-soluble polymer compound such as polyvinyl alcohol or carboxymethyl cellulose, inorganic fine particles, and a conductive agent, so long as the effects of the present invention are not impaired.

The content ratio of the first elastic polymer is preferably 0.1 to 60 mass %, more preferably 0.5 to 50 mass %, particularly preferably 1 to 30 mass %, relative to the mass of the ultrafine fibers, since a napped artificial leather having well-balanced fullness and pliability or the like can be obtained. When the content ratio of the first elastic polymer is too high, the napped artificial leather becomes rubber-like and tends to be hard. When the content ratio of the first elastic polymer is too low, the ultrafine fibers become easily pulled out from the napped surface by friction, so that the ultrafine fibers tend to be easily raised by friction.

Thus, a fiber base material that is a non-woven fabric of ultrafine fibers that has been impregnated with the first elastic polymer is obtained. The fiber base material thus obtained is sliced into a plurality of pieces or ground in a direction perpendicular to the thickness direction so as to adjust the thickness thereof if necessary, and is then preferably napped by being buffed on at least on one surface by using sand paper or emery paper with a grit number of preferably about 120 to 600, more preferably about 320 to 600. Thus, an artificial leather base material having a napped surface on which napped ultrafine fibers are present on one side or both sides is obtained.

It is preferable that a second elastic polymer is attached to the napped surface of the artificial leather base material in order to inhibit the napped ultrafine fibers from falling out and to make them difficult to be raised by friction. Specifically, a resin solution containing the second elastic polymer is applied to the napped surface, and thereafter solidified, to attach the second elastic polymer to the ultrafine fibers. By fixing the ultrafine fibers present on the napped surface by the second elastic polymer in this manner, the ultrafine fibers present on the napped surface are restrained by the second elastic polymer, so that the ultrafine fibers are difficult to fall out, and also difficult to be raised by friction. Consequently, it is possible to inhibit the occurrence of a rough, coarse appearance as a result of the napped surface being rubbed. By adjusting the amount of the resin solution containing the second elastic polymer applied to the napped surface, it is also possible to form a semi-grain leather finished surface on which a napped surface and a grain layer are both present.

The second elastic polymer may be the same as the first elastic polymer, or may be different from the first elastic polymer in type, molecular weight, or the like. Specific examples of the second elastic polymer also include elastic bodies such as polyurethane, an acryl-based resin, an acrylonitrile-based resin, an olefin-based resin, and a polyester-based resin. Among these, polyurethane is preferable since it can be easily attached to the ultrafine fibers. As the resin solution, it is possible to use a solution in which a resin is dissolved in a solvent, an emulsion in which a resin is emulsified and dispersed, and a dispersion in which a resin is dispersed in an aqueous solvent. As the second elastic polymer, a resin solution in which a resin is dissolved in a solvent such as N,N-dimethylformamide (DMF) is preferable in that the vicinity of the base of the ultrafine fibers can be fixed especially firmly, thus making the ultrafine fibers difficult be raised by friction.

Examples of the method for applying the resin solution containing the second elastic polymer to the napped surface of the artificial leather base material include gravure coating, bar coating, knife coating, roll coating, comma coating, and spray coating. Then, the resin solution containing the second elastic polymer is applied to the ultrafine fibers on the napped surface of the artificial leather base material, and optionally dried and solidified, thus attaching the second elastic polymer to the napped ultrafine fibers on the napped surface. In order to further increase the adhesion to the ultrafine fibers, it is preferable that the dried second elastic polymer is redissolved by being dissolved in a solvent, and thereafter dried.

The second elastic polymer may also further contain a colorant such as a dye or a pigment, a coagulation regulator, an antioxidant, an ultraviolet absorber, a fluorescent agent, an antifungal agent, a penetrant, an antifoaming agent, a lubricant, a water-repellent agent, an oil-repellent agent, a thickener, a filler, a curing accelerator, a foaming agent, a water-soluble polymer compound such as polyvinyl alcohol or carboxymethyl cellulose, inorganic fine particles, a conductive agent and the like, so long as the effects of the present invention are not impaired.

The content ratio (solid content) of the second elastic polymer is preferably 1 to 10 g/m$^2$, more preferably 2 to 8 g/m$^2$, relative to the napped surface of the artificial leather base material, because it is possible to firmly fix the ultrafine fibers without making the napped surface too hard, thus making it possible to decrease the length of the freely movable ultrafine fibers.

Then, the artificial leather base material is usually dyed. As the dye, a suitable dye is selected as appropriate according to the type of the ultrafine fibers. For example, when the ultrafine fibers are made from a polyester-based resin, it is preferable that the artificial leather substrate is dyed with a disperse dye or a cation dye. Specific examples of the disperse dye include benzene azo-based dyes (e.g., monoazo and disazo), heterocyclic azo-based dyes (e.g., thiazole azo, benzothiazole azo, quinoline azo, pyridine azo, imidazole azo, and thiophene azo); anthraquinone-based dyes, and condensate-based dyes (e.g., quinophthalone, styryl, and coumarin). These are commercially available as dyes with the prefix "Disperse", for example. These may be used alone or in a combination of two or more. As the dyeing method, it is possible to use a high-pressure jet dyeing method, a jigger dyeing method, a thermosol continuous dyeing machine method, a dyeing method using a sublimation printing process, and the like without any particular limitation.

The artificial leather base material may be further subjected to a shrinkage processing treatment or a flexibilizing treatment by crumpling or a relaxing treatment to adjust the texture, or a finishing treatment such as a reverse seal brushing treatment, an antifouling treatment, a hydrophilization treatment, a lubricant treatment, a softener treatment, an antioxidant treatment, an ultraviolet absorber treatment, a fluorescent agent treatment and a flame retardant treatment.

Examples of the shrinkage processing treatment include a treatment in which the artificial leather base material is brought into close contact with an elastic sheet, and mechanically shrunk in a longitudinal direction, and then subjected to a heat treatment in the shrunk state for heat setting. This shrinkage processing treatment will be described in further detail.

In the shrinkage processing treatment, the artificial leather base material is mechanically shrunk in the longitudinal direction (the advancing direction of the production line, or the orientation direction of the fibers), and is then heat-treated for heat setting, with the fibers being kept shrunk, thereby forming micro-waviness in the fibers in the cross section parallel to the longitudinal direction, which is the orientation direction of the fibers. With such waviness, the fibers are set in a shrunk state without being fully stretched, so that elasticity is imparted to the fibers in the longitudinal direction. Examples of the shrinkage processing treatment include a method in which the artificial leather base material is brought into close contact with a thick elastic sheet (e.g., a rubber sheet or felt) with a thickness of several centimeters on a surface thereof that has been extended in the longitudinal direction, and the surface of the elastic sheet is elastically recovered from the extended state to the state before being extended, thereby shrinking the artificial leather base material in the longitudinal direction.

In the shrinkage processing treatment, the artificial leather base material is firmly shrunk in the advancing direction (longitudinal direction). Preferably, the artificial leather base material that has been subjected to the shrinkage processing treatment has a micro-buckling structure (waviness structure) composed of a fiber bundle of ultrafine fibers and a given elastic polymer. The micro-buckling structure is a waviness structure that is formed along the longitudinal direction as a result of the artificial leather base material having been shrunk in the longitudinal direction. Since the artificial leather base material that has been subjected to the shrinkage processing treatment includes a fabric including ultrafine fibers, the waviness structure is likely to be formed. The waviness structure is not necessarily continuous, and may be discontinuous in the longitudinal direction. The artificial leather base material that has been subjected to the shrinkage processing treatment is stretched and shrunk in the longitudinal direction, not by the elasticity of the fibers, but by a change (extension) in such a buckling structure.

Thus, a dyed napped artificial leather having a napped surface is obtained. The napped artificial leather of the present embodiment is adjusted such that the napped surface has, as measured by a surface roughness measurement in accordance with ISO 25178, an arithmetic mean height (Sa) of 30 μm or less in both a grain direction and a reverse grain direction, and a density of peaks (Spd) having a height of 100 μm or more from a mean height, of 30/432 mm$^2$ or less in both of the grain direction and the reverse grain direction, and a difference (absolute value) in the density of peaks (Spd) between the grain direction and the reverse grain direction is 20/432 mm$^2$ or less. These surface states can be achieved by adjusting the combinations of the conditions for above-described steps during production, as will be described later.

Here, ISO 25178 (surface roughness measurement) prescribes a method for three-dimensionally measuring a surface state by using a contact or non-contact surface roughness/shape measuring machine. The arithmetic mean height (Sa) represents the mean of absolute values of the height differences of various points with respect to the mean plane of the surface. A density of peaks (Spd) having a height of 100 μm or more from the mean height indicates the number of peaks having a height of 100 μm or more from the mean height, in the number of peaks per unit area. The grain direction of the napped surface is a direction in which napped fibers collapse and are laid down when the napped surface is brushed with a seal brush, and the reverse grain direction is a direction in which the napped fibers are raised when the napped surface is brushed with a seal brush.

The napped artificial leather of the present embodiment is adjusted such that the napped surface of the napped artificial leather has an arithmetic mean height (Sa) of 30 μm or less in both a grain direction and a reverse grain direction, and a density of peaks (Spd) having a height of 100 μm or more from a mean height, of 30/432 $mm^2$ or less in both of the grain direction and the reverse grain direction, and a difference (absolute value) in the density of peaks (Spd) between the grain direction and the reverse grain direction is 20/432 $mm^2$ or less. Through this adjustment, the ultrafine fibers become difficult to freely move beyond a certain range no matter what direction the napped surface is rubbed. As a result, even when the napped surface is rubbed in the reverse grain direction, in which the ultrafine fibers can be easily raised, the ultrafine fibers will not be raised above a certain height, and can form a certain degree of writing. In addition, it is possible to inhibit the occurrence of a nonuniform and coarse appearance with a dry touch as a result of the napped surface being rubbed.

The arithmetic mean height (Sa) of the napped surface of the napped artificial leather is 30 μm or less, preferably 28 μm or less, more preferably 26 μm or less, most preferably 24 μm or less, in both of the grain direction and the reverse grain direction. When the arithmetic mean height (Sa) exceeds 30 μm in one of the grain direction and the reverse grain direction, the length of the freely movable ultrafine fibers tends to be excessively increased by the napped surface being rubbed, resulting in a nonuniform and coarse appearance with a dry touch. When the arithmetic mean height exceeds 30 μm in only one of the grain direction and the reverse grain direction, the difference in appearance between the two direction is increased, thus impairing the uniformity.

The density of peaks (Spd) having a height of 100 μm or more from the mean height of the napped surface of the napped artificial leather is 30/432 $mm^2$ or less, preferably 20/432 $mm^2$ or less, more preferably 18/432 $mm^2$ or less, in both of the grain direction and the reverse grain direction. When the density of peaks (Spd) exceeds 30/432 $mm^2$ in one of the grain direction and the reverse grain direction, a coarse appearance with a dry touch is formed as a result of the napped surface being rubbed. When the density of peaks (Spd) exceeds 30/432 $mm^2$ in only one of the grain direction and the reverse grain direction, the difference in appearance between the two direction is increased, thus impairing the uniformity.

Furthermore, the above-described density of peaks (Spd) is the number of peaks with which the difference between the grain direction and the reverse grain direction, as an absolute value, is 20/432 $mm^2$ or less, and is preferably 18/432 $mm^2$ or less, more preferably 16/432 $mm^2$ or less. When the difference in the density of peaks (Spd) between the grain direction and the reverse grain direction exceeds 20/432 $mm^2$ as an absolute value, the number of ultrafine fibers that easily move as a result of the napped surface being rubbed is increased, resulting in a rough, coarse appearance. When the density of peaks (Spd) exceeds 30/432 $mm^2$ in one of the grain direction and the reverse grain direction, the difference in appearance between the two direction is increased, thus impairing the uniformity.

In order to achieve the above-described surface states of the napped artificial leather according to the present embodiment, it is preferable to adjust the napped artificial leather by the following treatment. For example, by appropriately decreasing the length of the ultrafine fibers when napping the surface to be napped, it is possible to suppress the appearance change caused by the ultrafine fibers moving in a random direction when the napped surface is rubbed. By fixing the ultrafine fibers while adjusting the amount of the second elastic polymer applied, it is possible to inhibit a phenomenon that the ultrafine fibers fall out from the surface and the sticking-out ultrafine fibers gradually become longer, and these ultrafine fibers gather to form a large mass of fibers. In the case of performing the shrinkage processing treatment, the ultrafine fibers on the napped surface are thermally set by application of heat in an appropriately laid-down state, and, thereby, the ultrafine fibers become difficult to be raised above a certain height, making it possible to achieve a state in which the ultrafine fibers are restrained, with the napped state being fixed to a certain degree.

Furthermore, the fiber toughness serving as an index indicating the tenacity and the level of rigidity per one ultrafine fiber is preferably 8 to 40 cN·%, more preferably 10 to 30 cN·%, on the average. When the fiber toughness is within this range, the ultrafine fibers will not become too hard, so that the laid-down ultrafine fibers are difficult to be raised, and the ultrafine fibers tend to be easily made shorter since the napping facilitates cutting of the ultrafine fibers to an appropriate degree. The fiber toughness is a tensile toughness per one ultrafine fiber that can be calculated as described below. When the fiber toughness is too high, the ultrafine fibers tend to be easily raised when the napped surface is rubbed, resulting in a nonuniform and coarse appearance with a rough dry touch. On the other hand, when the fiber toughness is too low, the color development and the fastness tend to be degraded when the napped artificial leather is dyed.

The apparent density of the napped artificial leather is preferably 0.4 to 0.7 $g/cm^3$, more preferably 0.45 to 0.6 $g/cm^3$, since a napped artificial leather that is well-balanced in fullness and a flexible texture that does not cause sharp bending can be obtained. When the apparent density of the napped artificial leather is too low, sharp bending tends to occur due to a low level of fullness. Further, the ultrafine fibers tend to be easily pulled out by rubbing the napped surface, resulting in a nonuniform and coarse appearance with a rough dry touch. On the other hand, when the apparent density of the napped artificial leather is too high, the flexible texture tends to be reduced.

EXAMPLES

Hereinafter, the present invention will be described more specifically by way of examples. It should be appreciated that the scope of the present invention is by no means limited by the examples.

Example 1

Ethylene-modified polyvinyl alcohol (PVA) as a thermoplastic resin serving as a sea component and a modified PET that had been isophthalic acid-modified (content ratio of isophthalic acid unit:6 mol %) as a thermoplastic resin serving as an island component were molten separately. Then, each of the molten resins was supplied to a composite fiber spinning spinneret having 12 nozzle holes disposed in parallel so as to form a cross section on which 12 island component portions having a uniform cross-sectional area were distributed in the sea component. At this time, the molten resins were supplied while adjusting the throughput such that the mass ratio between the sea component and the island component, which had been designed such that the island component was 0.30 dtex, satisfied Sea component/Island component=25/75. Then, the molten fibers were discharged from the nozzle holes set at a spinneret temperature of 260° C. at a throughput per hole of 1.5 g/min.

Then, the molten fibers discharged from the nozzle holes were stretched by suction using an air-jet nozzle suction apparatus with an air stream pressure regulated so as to provide a spinning speed of 3700 m/min, and thereby to spin island-in-the-sea composite long fibers with an average fineness of 4.8 dtex. The spun island-in-the-sea composite long fibers were continuously piled on a movable net while being suctioned from the back side of the net. Thus, a long-fiber web (spunbonded sheet) having a basis weight of about 54 g/m$^2$ was obtained.

Next, 12 layers of the long-fiber web were stacked using a cross lapper apparatus to form a superposed web with a basis weight of 648 g/m$^2$, and an oil solution for preventing the needle from breaking was further sprayed thereto. Then, the superposed web was needle-punched, and thereby to perform a three-dimensional entangling treatment. Specifically, the superposed body was needle-punched using 1-barb 42-gauge needles and 6-barb 42-gauge needles at 4189 punch/cm$^2$, to achieve entanglement, and thereby to obtain a web entangled sheet. The obtained web entangled sheet had a basis weight of 795 g/m$^2$ and a delamination strength of 10.5 kg/2.5 cm. The area shrinkage due to the needle punching was 21.5%.

The obtained web entangled sheet was subjected to a steam treatment under the conditions of 110° C. and 23.5% RH, to shrink the area by 48%. Then, the web entangled sheet was dried in an oven at 90 to 110° C., and thereafter further hot-pressed at 115° C., thereby obtaining a heat-shrunk web entangled sheet having a basis weight of 1382 g/m$^2$, an apparent density of 0.682 g/cm$^3$, and a thickness of 2.03 mm.

Next, the heat-shrunk web entangled sheet was impregnated with an emulsion (solid content: 22.5 mass %) of a polyurethane elastic body at a pick up of 50%. Note that the polyurethane elastic body is a polycarbonate-based non-yellowing polyurethane. To the emulsion were added 4.9 parts by mass of a carbodiimide-based crosslinking agent and 6.4 parts by mass of ammonium sulfate, per 100 parts by mass of the polyurethane elastic body, and the solid content of the polyurethane elastic body was adjusted to be 13% relative to the mass of the ultrafine fibers. The polyurethane elastic body forms a cross-linked structure by being heat-treated. Then, the heat-shrunk web entangled sheet that had been impregnated with the emulsion was dried under an atmosphere of 115° C. and 25% RH, and further dried at 150° C. Next, the web entangled sheet into which the polyurethane elastic body had been added was immersed in hot water at 95° C. for 10 minutes, while being subjected to nipping and high-pressure water jetting, to remove PVA by dissolution, and was further dried. Thus, a composite body of the polyurethane elastic body and a non-woven fabric that was the entangled body of ultrafine long fibers, with a single fiber fineness of 0.30 dtex, a basis weight of 1097 g/m$^2$, an apparent density of 0.572 g/cm$^3$, and a thickness of 1.92 mm, was obtained.

Next, the composite body of the polyurethane elastic body and the non-woven fabric that was the entangled body of a fiber bundle of ultrafine long fibers was sliced into two pieces with a uniform thickness. Then, both sides of each of the sliced pieces were ground under the conditions of a speed of 3 m/min and a rotation rate of 650 rpm, using a paper with a grid number of 120 for the back surface and papers with grid numbers of 240, 320, and 600 for the main surface, to obtain an artificial leather base material having a basis weight of 391 g/m$^2$, an apparent density of 0.536 g/cm$^3$, and a thickness of 0.73 mm.

Then, a solution with a solid content of 7 mass % in which a polycarbonate-based non-yellowing polyurethane had been dissolved in DMF was applied as the second elastic polymer to the main surface, and then dried. Further, a liquid of DMF/cyclohexanone=10/90 was applied to the main surface, thereby applying the second elastic polymer to the vicinity of the base of the ultrafine fibers that had been napped on the napped surface. Note that the second elastic polymer was applied at a proportion of 2 g/m$^2$. Then, using a disperse dye, high-pressure dyeing was performed at 120° C., to obtain a black napped artificial leather base material.

Next, a flame retardancy treatment was performed on the back surface of the napped artificial leather base material, followed by a shrinkage processing treatment. Specifically, using a shrinkage processing apparatus (a sanforizing machine manufactured by Komatsubara Tekko K.K.) including a humidifying unit, a shrinking portion for shrinking the napped artificial leather base material continuously sent from the humidifying unit, and a heat-setting portion for heat-setting the fabric that had been shrunk by the shrinking portion, the treatment was performed at a temperature of the shrinking portion of 120° C., a drum temperature of the heat setting portion of 120° C., and a transport speed of 10 m/min, and thereby to obtain a suede-like napped artificial leather having an ultrafine fiber fineness of 0.323 dtex, a basis weight of 442 g/m$^2$, an apparent density 0.526 g/cm$^3$, and a thickness of 0.84 mm. The fiber toughness, which is a tensile toughness per one ultrafine fiber that formed the non-woven fabric included in the napped artificial leather, was 22.9 cN·%. Note that the fiber toughness was measured and calculated as follows.

[Fiber Toughness Measurement]

A plurality of island-in-the-sea composite long fibers that had been spun were attached with cellophane adhesive tape to the surface of a polyester film in a state in which the long fibers were slightly loosened. Then, the sea component was removed by extraction by immersing the island-in-the-sea composite long fibers in hot water at 95° C. for 30 minutes or more, thereby obtaining ultrafine long fibers. Next, the polyester film to which the ultrafine long fibers had been fixed was dyed using a Pot dyeing machine at 120° C. for 20 minuets, to obtain dyed fibers. Then, the elongation was measured with an autograph while a bundle of the ultrafine fibers equivalent to a single island-in-the-sea composite long fiber from among the dyed fibers were kept bound, and the elongation of the fiber bundle of the ultrafine fibers was measured with the autograph. Then, the breaking strength and the breaking elongation were read from the peak top of the obtained SS curve. Then, the fiber toughness was calculated from the equation: Dyed fiber toughness (cN·%) =Breaking strength (cN)×Breaking elongation (%)/Number of ultrafine fibers.

Then, for the obtained napped artificial leather, the surface state of the napped surface was measured according to the following evaluation method.

[Measurement of Surface State of Napped Surface]

Figure 3A:
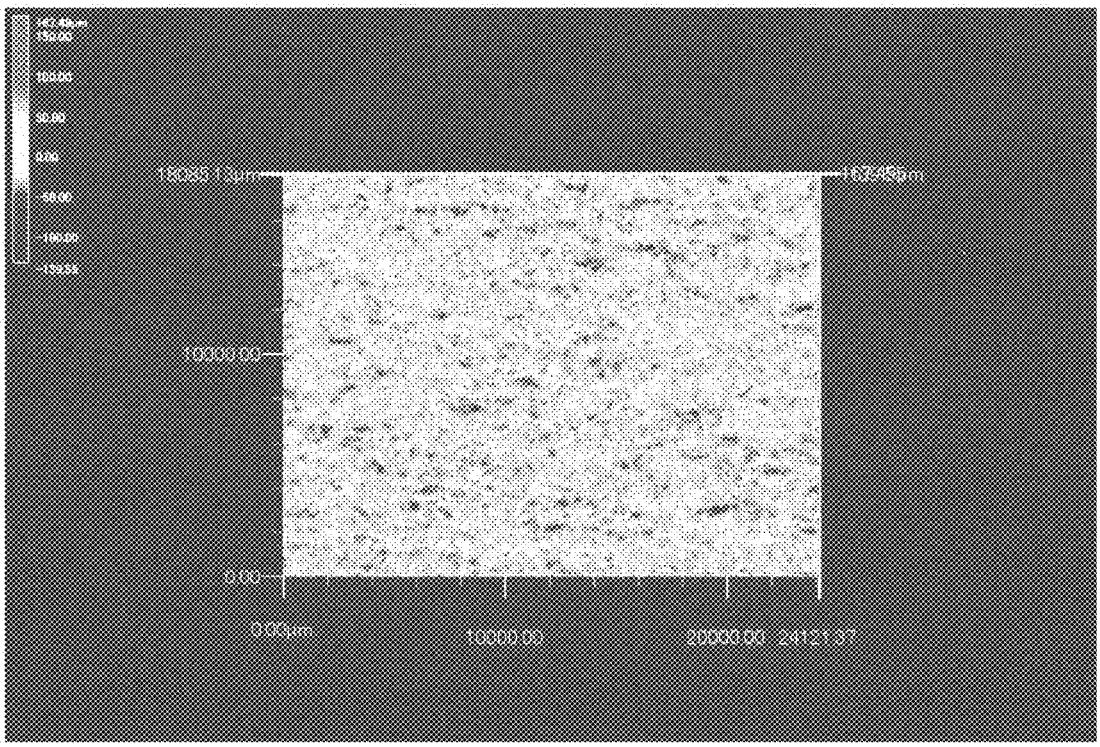
FIG. 3A shows a 3D image, observed using a microscope, of the surface of the napped artificial leather obtained in Example 1, showing the image in the grain direction.
Figure 3B:
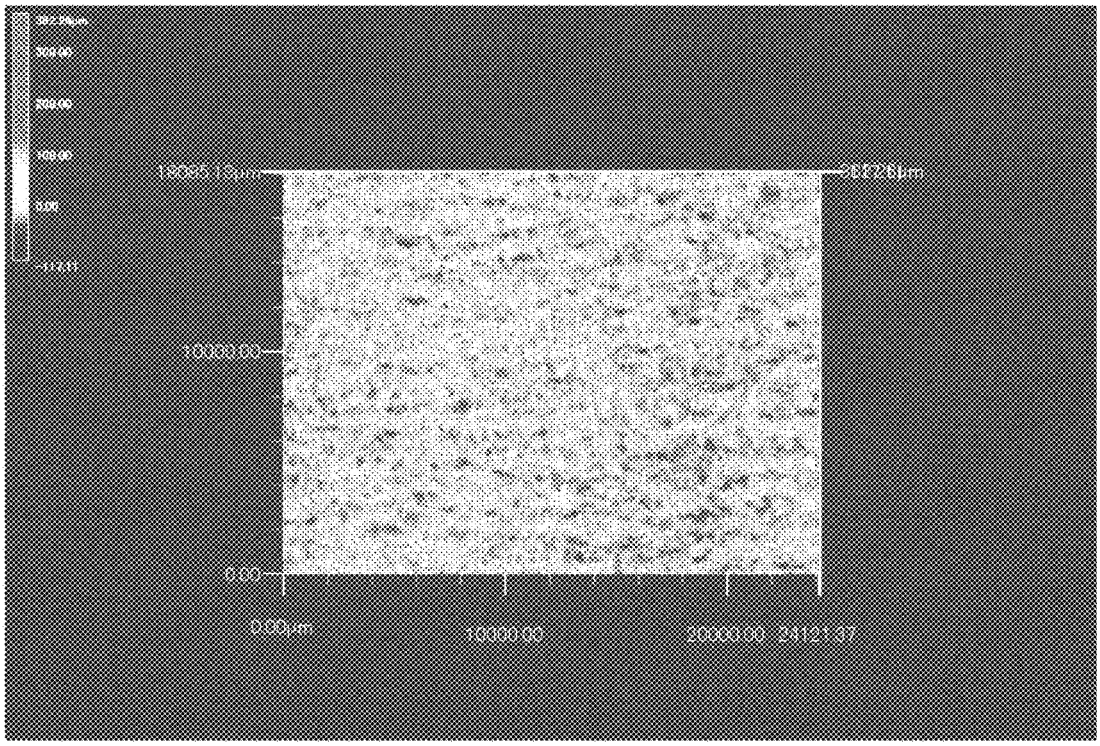
FIG. 3B shows a 3D image, observed using a microscope, of the surface of the napped artificial leather obtained in Example 1, showing the image in the reveres grain direction.

The surface state of the napped surface of the napped artificial leather was measured in accordance with ISO 25178 (surface roughness measurement), using "One-Shot 3D Measuring Macroscope VR-3200" (manufactured by KEYENCE CORPORATION), which was a non-contact surface roughness/shape tester. Specifically, the napped surface of the napped artificial leather was brushed with a seal brush in each of the grain direction and the reverse grain direction. Then, for a range of 18 mm×24 mm of the brushed napped surface, distorted fringe images were captured using a 4 mega-pixel monochrome C-MOS camera at a magnification of 12× under structured illumination light emitted from a high-intensity LED, and the arithmetic mean height (Sa) and the density of peaks (Spd) having a height of 100 μm or more from the mean height in each of the directions were determined. Here, the direction in which the napped fibers collapsed was the grain direction, and the direction in which they rose was the reverse grain direction. The measurement was carried out three times, and the average values thereof were used as the numerical values. Each of FIGS. 3A and 3B shows a 3D image obtained when the surface of the napped artificial leather obtained in Example 1 was measured in the above-described manner. FIG. 3A shows the image in the grain direction, and FIG. 3B shows the image in the reverse grain direction.

Then, for the obtained napped artificial leather, the quality of the napped surface after being rubbed was measured according to the following evaluation method.

[Quality of Napped Surface after being Rubbed]

The napped surface of the obtained napped artificial leather was subjected to an inverse Martindale measurement of the Martindale measurement (JIS L 1096). Specifically, the napped surface of an original fabric of the napped artificial leather that was set on a pedestal in an unloaded state was rubbed with the standard rubbing cloth SM25 for 50 times, and the appearance at that time was evaluated according to the following criteria.

A: The napped surface had a uniform and dense appearance even after being rubbed in the grain direction and the reverse grain direction.

B: When rubbed in the reverse grain direction, the napped surface clearly exhibited a nonuniform and coarse appearance with a dry touch that showed dot-like irregularities or an exposed underlayer due to coarse ultrafine fibers.

Figure 2:
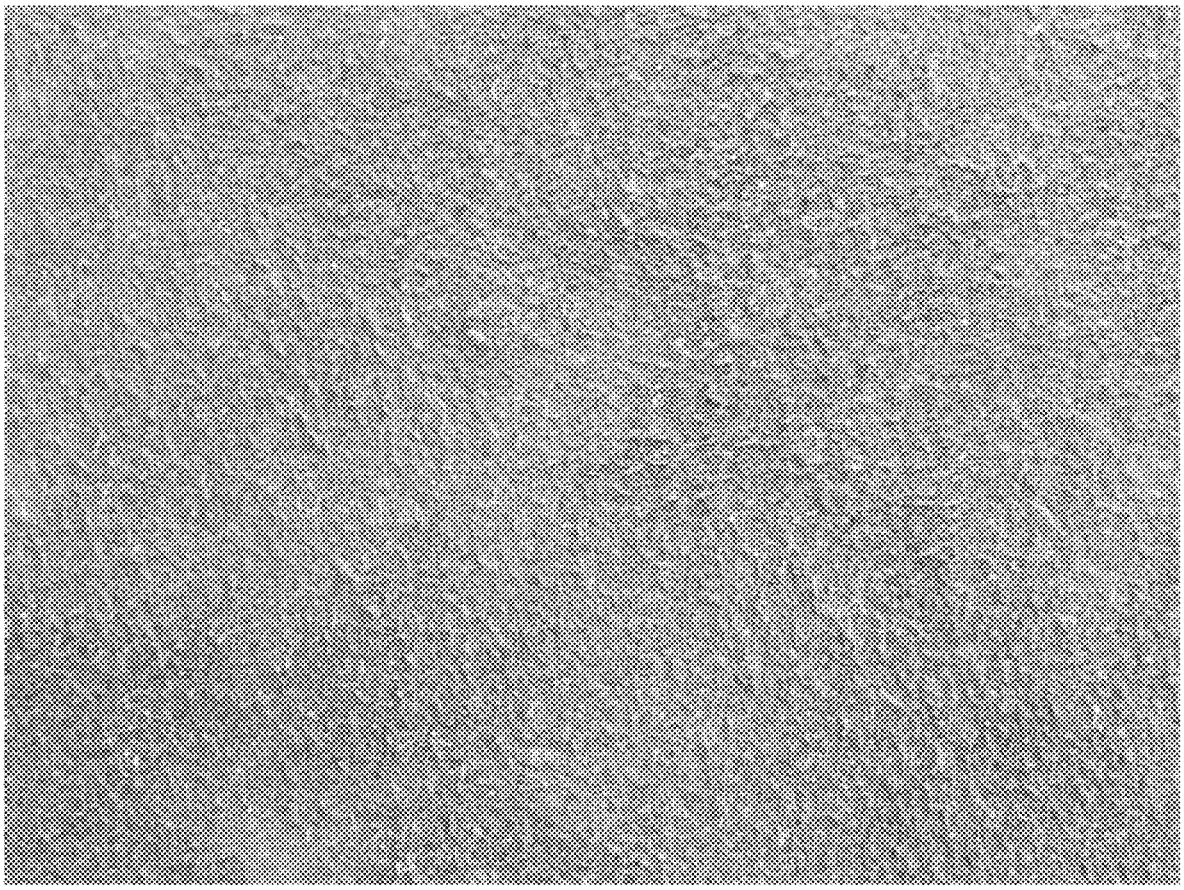
FIG. 2 is a photograph of the surface of a napped surface of a napped artificial leather obtained in Comparative Example 1 after evaluating the quality after being rubbed.

The results are collectively shown in Table 1. FIG. 1 shows a photograph of the napped surface of the napped artificial leather obtained in Example 1 after evaluating the quality after being rubbed. FIG. 2 shows a photograph of the napped surface of a napped artificial leather obtained in Comparative Example 1, which will be described later, after evaluating the quality after being rubbed.

TABLE 1

| Example No. | Example 1 | Example 2 | Example 3 | Example 4 | Example 5 | Example 6 | Com. Ex. 1 | Com. Ex. 2 | Com. Ex. 3 | Com. Ex. 4 |
|---|---|---|---|---|---|---|---|---|---|---|
| Average fineness (dtex) | 0.323 | 0.255 | 0.206 | 0.121 | 0.095 | 0.121 | 0.323 | 0.323 | 0.255 | 0.255 |
| Fiber toughness (cN · %) | 22.9 | 18.5 | 22.1 | 14.3 | 13.5 | 14.3 | 22.1 | 22.1 | 18.5 | 18.5 |
| Shrinkage processing | Performed | Performed | Performed | Performed | Performed | Performed | Performed | Not-performed | Performed | Not-performed |
| Second elastic polymer ($g/m^2$) | 2 | 2 | 2 | 2 | 2 | 3 (Em) | 0 | 0 | 0 | 0 |
| Needle density ($punch/cm^2$) | 4189 | 4189 | 4277 | 3745 | 3745 | 3745 | 4189 | 4189 | 4189 | 4189 |
| Basis weight ($g/m^2$) | 442 | 465 | 265 | 449 | 445 | 455 | 445 | 389 | 434 | 389 |
| Thickness (mm) | 0.84 | 0.84 | 0.49 | 0.83 | 0.82 | 0.84 | 0.84 | 0.80 | 0.82 | 0.79 |
| Apparent density ($g/cm^3$) | 0.526 | 0.551 | 0.541 | 0.541 | 0.543 | 0.542 | 0.528 | 0.486 | 0.528 | 0.492 |
| Arithmetic mean height (Sa) | | | | | | | | | | |
| (Grain direction, μm) | 20.57 | 18.12 | 15.28 | 12.40 | 15.16 | 14.97 | 22.23 | 30.86 | 27.21 | 29.50 |
| (Reverse grain direction, μm) | 23.89 | 22.81 | 14.79 | 20.11 | 14.75 | 16.40 | 26.34 | 29.99 | 30.19 | 33.05 |
| (Difference between grain direction and Reverse grain direction, μm) | 3.32 | 4.70 | 0.49 | 7.71 | 0.41 | 1.43 | 4.11 | 0.86 | 2.98 | 3.55 |
| Density of peaks (Spd) | | | | | | | | | | |
| (Grain direction, / 432 $mm^2$) | 0.33 | 0 | 0 | 0 | 0 | 2.33 | 5.67 | 39.33 | 39.00 | 36.67 |
| (Reverse grain direction, /432 $mm^2$) | 16.67 | 11.33 | 0 | 12.30 | 0.67 | 4.67 | 27.33 | 41.67 | 40.00 | 61.33 |
| (Difference between grain direction and Reverse grain direction, /432 $mm^2$) | 16.33 | 11.33 | 0 | 12.30 | 0.67 | 2.33 | 21.67 | 2.33 | 1.00 | 24.67 |
| Quallity after being rubbed | A | A | A | A | A | A | B | B | B | B |

Example 2

A napped artificial leather was obtained in the same manner as in Example 1, except that ultrafine fibers having a design value of a single fiber fineness of 0.25 dtex were formed instead of forming the ultrafine fibers having a design value of a single fiber fineness of 0.30 dtex, and the obtained napped artificial leather was evaluated. The results are shown in Table 1.

Example 3

A napped artificial leather was obtained in the same manner as in Example 1, except that ultrafine fibers having a design value of a single fiber fineness of 0.20 dtex were formed instead of forming the ultrafine fibers having a design value of a single fiber fineness of 0.30 dtex, and that the superposed body was needle-punched at 4277 punch/$cm^2$ instead of being needle-punched at 4189 punch/$cm^2$ in the formation of the web entangled sheet, and the obtained napped artificial leather was evaluated. The results are shown in Table 1.

Example 4

A napped artificial leather was obtained in the same manner as in Example 1, except that ultrafine fibers having a design value of a single fiber fineness of 0.10 dtex were formed instead of forming the ultrafine fibers having a design value of a single fiber fineness of 0.30 dtex, and that the superposed body was needle-punched at 3745 punch/$cm^2$ instead of being needle-punched at 4189 punch/$cm^2$ in the formation of the web entangled sheet, and the obtained napped artificial leather was evaluated. The results are shown in Table 1.

Example 5

A napped artificial leather was obtained in the same manner as in Example 1, except that ultrafine fibers having a design value of a single fiber fineness of 0.08 dtex were formed instead of forming the ultrafine fibers having a design value of a single fiber fineness of 0.30 dtex, and that the superposed body was needle-punched at 3745 punch/$cm^2$ instead of being needle-punched at 4189 punch/$cm^2$ in the formation of the web entangled sheet, and the obtained napped artificial leather was evaluated. The results are shown in Table 1.

Example 6

A napped artificial leather was obtained in the same manner as in Example 4, except that a polyurethane emulsion was applied instead of applying the polyurethane solution in the step of applying the second elastic polymer, and the obtained napped artificial leather was evaluated. The results are shown in Table 1.

Comparative Example 1

Figure 4A:
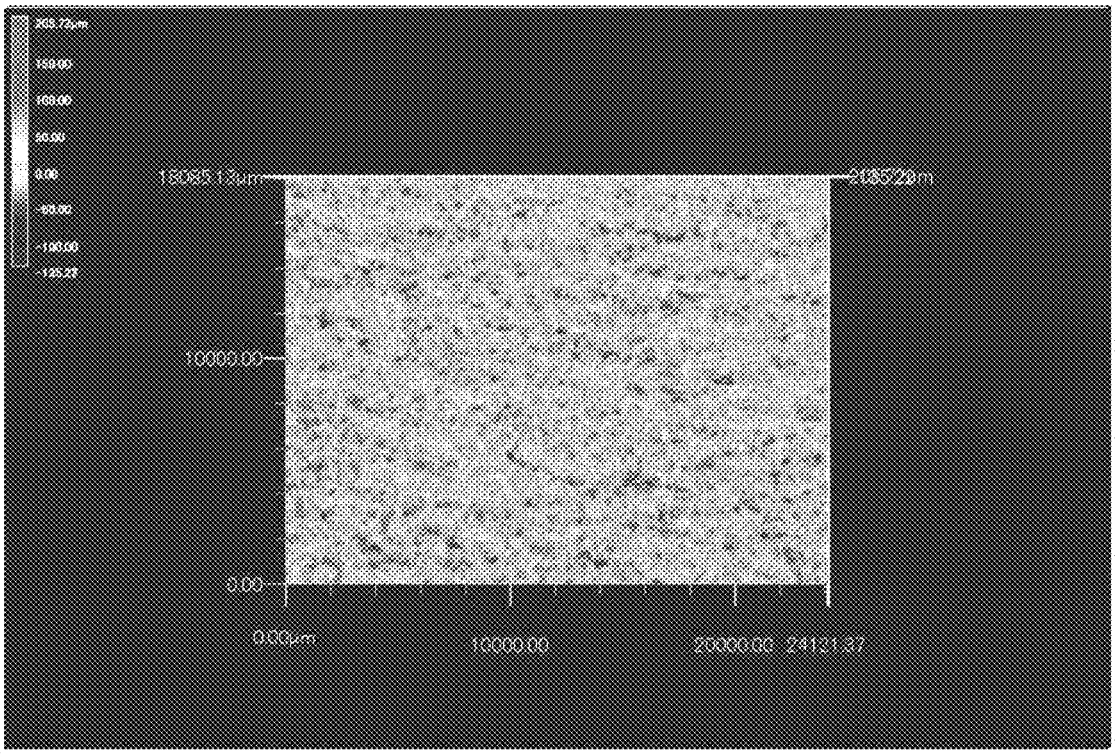
FIG. 4A shows a 3D image, observed using a microscope, of the surface of the napped artificial leather obtained in Comparative Example 1, showing the image in the grain direction.
Figure 4B:
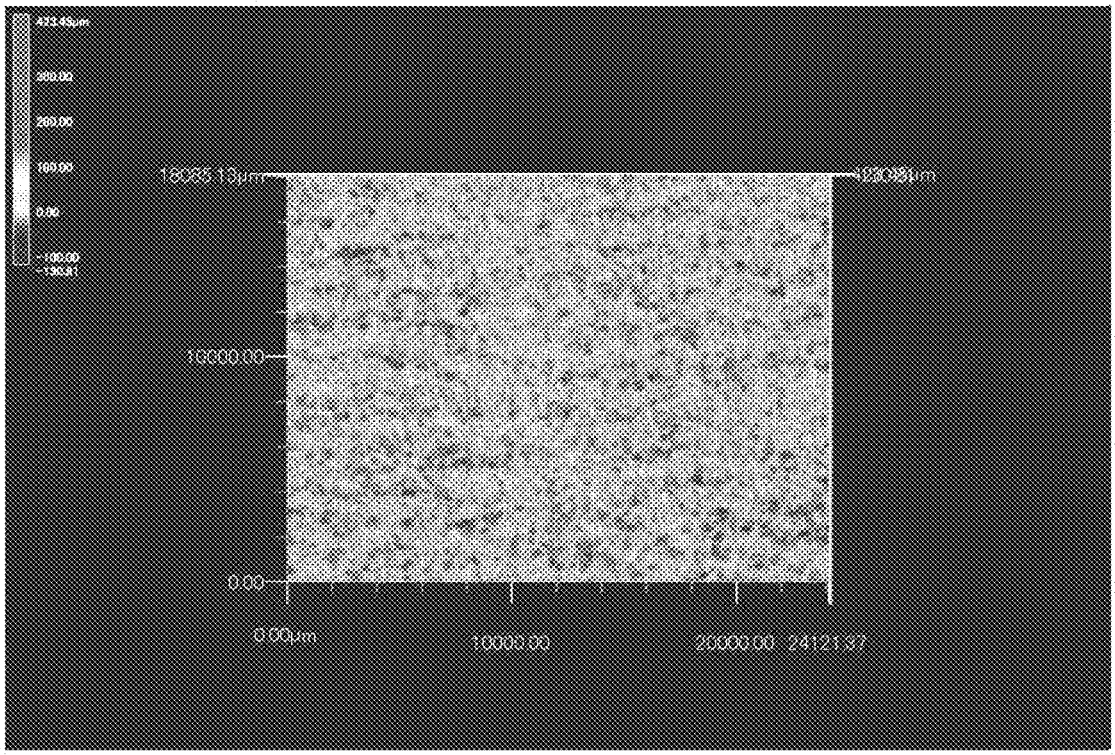
FIG. 4B shows a 3D image, observed using a microscope, of the surface of the napped artificial leather obtained in Comparative Example 1, showing the image in the reverse grain direction.

A napped artificial leather was obtained in the same manner as in Example 1, except that the step of applying the second elastic polymer was omitted, and the obtained napped artificial leather was evaluated. The results are shown in Table 1. Each of FIGS. 4A and 4B shows a 3D image obtained when the surface of the napped artificial leather obtained in Comparative Example 1 was measured in the above-described manner. FIG. 4A shows the image in the grain direction, and FIG. 4B shows the image in the reverse grain direction.

Comparative Example 2

A napped artificial leather was obtained in the same manner as in Example 1, except that the step of applying the second elastic polymer was omitted, and that the step of performing the flame retardancy treatment and the shrinkage processing treatment on the back surface of the napped artificial leather base material was omitted, and the obtained napped artificial leather was evaluated. The results are shown in Table 1.

Comparative Example 3

A napped artificial leather was obtained in the same manner as in Example 2, except that the step of applying the second elastic polymer was omitted, and the obtained napped artificial leather was evaluated. The results are shown in Table 1.

Comparative Example 4

A napped artificial leather was obtained in the same manner as in Example 2, except that the step of applying the second elastic polymer was omitted, and that the step of performing the flame retardancy treatment and the shrinkage processing treatment on the back surface of the napped artificial leather base material was omitted, and the obtained napped artificial leather was evaluated. The results are shown in Table 1.

Referring to Table 1, each of the napped artificial leathers of Examples 1 to 6, in which Sa was 30 μm or less in both of the grain direction and the reverse grain direction, Spd was 30/432 $mm^2$ or less in both of the grain direction and the reverse grain direction, and the difference (absolute value) in each of Spd between the two directions was 20/432 $mm^2$ or less, had a uniform and dense appearance as shown in FIG. 1 even after being rubbed in the grain direction and the reverse grain direction. Note that the napped artificial leather of Example 6 to which the polyurethane emulsion was applied as the second elastic polymer, had a slightly degraded appearance. On the other hand, each of the napped artificial leathers of Comparative Examples 1 to 4 had a nonuniform and coarse appearance with a dry touch as shown in FIG. 2.

INDUSTRIAL APPLICABILITY

A napped artificial leather obtained according to the present invention can be preferably used as a skin material for clothing, shoes, articles of furniture, car seats, general merchandise, and the like.

The invention claimed is:

1. A napped artificial leather, comprising:

a fabric impregnated with a first elastic polymer and having a napped surface comprising napped ultrafine fibers with an average fineness of 0.01 to 0.5 dtex, wherein the napped surface has, as measured by a surface roughness measurement in accordance with ISO 25178, an arithmetic mean height (Sa) of 30 μm or less in both a grain direction and a reverse grain direction, and a density of peaks (Spd) having a height of 100 μm or more from a mean height, of 30/432 $mm^2$ or less in both the grain direction and the reverse grain direction, and an absolute value of a difference in the density of peaks (Spd) between the grain direction and the reverse grain direction of 20/432 $mm^2$ or less.

2. The napped artificial leather of claim 1, wherein the fabric comprises at least one selected from the group consisting of a non-woven fabric, a woven fabric, and a knitted fabric.

3. The napped artificial leather of claim 1, wherein the napped ultrafine fibers on the napped surface have a second elastic polymer attached thereto.

4. The napped artificial leather of claim 3, wherein the napped ultrafine fibers on the napped surface have the second elastic polymer attached to at least the vicinity of a base thereof.

5. The napped artificial leather of claim 1, wherein an average fiber toughness is 8 to 40 cN·%.

6. The napped artificial leather of claim 1, wherein the fabric comprises a non-woven fabric, and the napped ultrafine fibers are long fibers.

7. The napped artificial leather of claim 1, wherein an apparent density is 0.4 to 0.7 g/cm$^3$.

8. A method of producing the napped artificial leather of claim 1, the method comprising:

preparing an artificial leather base material comprising a fabric impregnated with a first elastic polymer, wherein the fabric comprises a surface to be napped and the surface comprises ultrafine fibers with an average fineness of 0.01 to 0.5 dtex;

napping the surface, to form a napped surface;

attaching a second elastic polymer to the ultrafine fibers on the napped surface; and thermally setting the artificial leather base material in a state in which the artificial leather base material is shrunk along a longitudinal direction that is an orientation direction of the fibers.

* * * * *